US010790592B2

(12) United States Patent
You et al.

(10) Patent No.: US 10,790,592 B2
(45) Date of Patent: Sep. 29, 2020

(54) LOW-PROFILE CTS FLAT-PLATE ARRAY ANTENNA

(71) Applicant: Ningbo University, Zhejiang (CN)

(72) Inventors: Qingchun You, Zhejiang (CN); Jifu Huang, Zhejiang (CN); Liting Qin, Zhejiang (CN); Yang You, Zhejiang (CN)

(73) Assignee: Ningbo University, Zhejiang (CN)

( * ) Notice: Subject to any disclaimer, the term of this patent is extended or adjusted under 35 U.S.C. 154(b) by 22 days.

(21) Appl. No.: 16/414,727

(22) Filed: May 16, 2019

(65) Prior Publication Data

US 2020/0014116 A1 Jan. 9, 2020

(30) Foreign Application Priority Data

Jul. 9, 2018 (CN) ..... 2018 1 0742447

(51) Int. Cl.

| | |
|---|---|
| ***H01Q 13/18*** | (2006.01) |
| ***H01P 1/16*** | (2006.01) |
| ***H01Q 21/00*** | (2006.01) |

(52) U.S. Cl.

CPC ..... *H01Q 13/18* (2013.01); *H01P 1/16* (2013.01); *H01Q 21/0006* (2013.01)

(58) Field of Classification Search

CPC ..... H01Q 5/25; H01Q 7/02; H01Q 13/065; H01Q 5/342; H01Q 5/28; H01Q 21/0006; H01Q 13/10; H01Q 13/106; H01Q 13/18; H01Q 15/246; H01P 3/123; H01P 5/16

USPC ..... 343/786, 700 MS, 702, 772

See application file for complete search history.

(56) References Cited

U.S. PATENT DOCUMENTS

2012/0007783 A1* 1/2012 Taura ..... H01Q 1/2266 343/702

* cited by examiner

*Primary Examiner* — Wei (Victor) Y Chan
(74) *Attorney, Agent, or Firm* — JCIPRNET

(57) ABSTRACT

A low-profile CTS flat-plate array antenna includes a radiating layer, a mode switching layer and a feed network layer which are sequentially arrayed from top to bottom. The mode switching layer comprises a first metal plate and a mode switching cavity array arranged on an upper surface of the first metal plate and comprising $2^{2n}$ mode switching cavities arrayed in $2^n$ rows and $2^n$ columns, wherein n is an integer greater than or equal to 1. Each mode switching cavity includes a first rectangular cavity, a second rectangular cavity, a third rectangular cavity, a fourth rectangular cavity and a fifth rectangular cavity which are sequentially connected from left to right. The $2^n$ mode switching cavities located in each row are sequentially connected end to end.

4 Claims, 5 Drawing Sheets

LOW-PROFILE CTS FLAT-PLATE ARRAY ANTENNA

CROSS-REFERENCE TO RELATED APPLICATION

This application claims the priority benefit of Chinese application serial no. 201810742447.4, filed on Jul. 9, 2018. The entirety of the above-mentioned patent application is hereby incorporated by reference herein and made a part of this specification.

BACKGROUND

Technical Field

The invention relates to a CTS plate array antenna, in particular to a low-profile CTS flat-plate array antenna.

Description of Related Art

In recent years, CTS plate array antennas with the characteristics of low standing waves, high gains, high efficiency, low costs and insensitivity to fabrication precision have gained more and more attention and are formed by forming tangent slots in a parallel-plate waveguides. Longitudinal current components generated by the parallel-plate waveguide excited by any plane waves will be cut off by horizontal slots, longitudinal displacement currents are generated at the junction of the tangent slots and the parallel-plate waveguide, and at this moment, energy transmitted in the parallel-plate waveguide is coupled through continuous transverse stubs, and electromagnetic waves are radiated to outside.

An existing CTS plate array antenna generally comprises a flat-plate reflector, waveguide power dividers and a radiating unit. The flat-plate reflector comprises an H-plane sectorial horn antenna, an offset parabolic reflecting surface and a planar waveguide. The H-plane sectorial horn antenna and the offset parabolic reflecting surface are arranged in the planar waveguide, and a phase center of the H-plane sectorial horn antenna is located at a focal point of the offset parabolic reflecting surface. The waveguide power dividers are connected to one end of the offset parabolic reflecting surface, located on an E-plane of the plate array antenna and uniformly distributed on the E-plane of the plate array antenna. The radiating unit comprises a rectangular waveguide and a dielectric grating orthogonally assembled relative to the rectangular waveguide. In this CTS plate array antenna, the flat-plate reflector generates plane waves converted from cylindrical waves based on the reflector antenna principle, the H-plane sectorial horn antenna is arranged on the focal point of the parabolic reflector, and a radiation field of the horn antenna generates constant-amplitude in-phase plane waves on the offset parabolic reflecting surface.

However, the existing CTS plate array antenna has the following drawbacks. First, the offset parabolic reflecting surface of the flat-plate reflector requires a large space and has a large size; second, the offset parabolic reflecting surface has a high machining requirement. In the assembling process, the focal point of the offset parabolic reflecting surface has to be strictly aligned to the phase center of the H-plane sectorial horn antenna, and the assembling requirement is high. And third, the waveguide power divider is formed by stacking at least four waveguide power dividing layers, thereby having a large size. All the waveguide power dividing layers are assembled after being independently machined, so that the assembling process is complex, and the assembling requirement is high.

SUMMARY

The technical issue to be settled by the invention is to provide a low-profile CTS flat-plate array antenna which is small in size and easy to machine and assemble while having a broadband, a high gain and high efficiency.

The following technical solution is adopted by the invention to settle the above technical issue. A low-profile CTS flat-plate array antenna sequentially includes a radiating layer, a mode switching layer and a feed network layer which are sequentially arrayed from top to bottom. The mode switching layer comprises a first metal plate and a mode switching cavity array arranged on an upper surface of the first metal plate. The mode switching cavity array comprises $2^{2n}$ mode switching cavities which are arrayed in $2^n$ rows and $2^n$ columns, wherein n is an integer greater than or equal to 1, and the $2^n$ mode switching cavities located in each row are sequentially connected end to end; each mode switching cavity comprises a first rectangular cavity, a second rectangular cavity, a third rectangular cavity, a fourth rectangular cavity and a fifth rectangular cavity which are sequentially connected from left to right. The first rectangular cavity, the second rectangular cavity, the third rectangular cavity, the fourth rectangular cavity and the fifth rectangular cavity have long edges in a row direction of the mode switching cavity array and wide edges in the column direction of the mode switching cavity array. With a center of the first rectangular cavity as a baseline, a center of the second rectangular cavity deviates forwards relative to the center of the first rectangular cavity. A front long edge of the second rectangular cavity extends beyond a front long edge of the first rectangular cavity, a center of the third rectangular cavity and the center of the first rectangular cavity are located on a same line and are parallel to the long edges of the first rectangular cavity, the fourth rectangular cavity and the second rectangular cavity are symmetrical with respect to the center of the third rectangular cavity, and the fifth rectangular cavity and the first rectangular cavity are symmetrical with respect to the center of the third rectangular cavity. The first rectangular cavity, the second rectangular cavity, the third rectangular cavity, the fourth rectangular cavity and the fifth rectangular cavity are formed by rectangular grooves formed in the upper surface of the first metal plate, heights of the first rectangular cavity, the second rectangular cavity, the third rectangular cavity, the fourth rectangular cavity and the fifth rectangular cavity are equal and are smaller than a height of the first metal plate. A width of the first rectangular cavity is smaller than that of the third rectangular cavity, a width of the third rectangular cavity is smaller than that of the second rectangular cavity, a width of the second rectangular cavity is smaller than half of a wavelength, a width of the fifth rectangular cavity is equal to that of the first rectangular cavity, and a width of the fourth rectangular cavity is equal to that of the second rectangular cavity. A lower surface of the first metal plate is provided with $2^{2n}$ input ports which are arrayed in $2^{2n}$ rows and $2^{2n}$ columns, formed by rectangular grooves formed in the lower surface of the first metal plate and vertically communicated with the $2^{2n}$ mode switching cavities in a one-to-one correspondence manner. As for each input port and the mode switching cavity correspondingly communicated with the input port, a vertical central axis of the input port overlaps a vertical central axis of the third rectangular cavity in the mode switching cavity, long edges of the input port are parallel to the long edges of the third rectangular cavities and are shorter than the long edges of the third rectangular cavity, and wide edges of the input port are parallel to the wide edges of the third rectangular cavity and are narrower than the wide edges of the third rectangular cavity. A center distance between the input port in the $k^{th}$ row and the $j^{th}$ column and the input port in the $k^{th}$ row and the $(j+1)^{th}$ column ranges from 0.8 time of the wavelength to 1.2 times of the wavelength, and the center distance between the input port in the $k^{th}$ row and the $j^{th}$ column and the input port in the $(k+1)^{th}$ row and the $j^{th}$ column ranges from 0.8 time of the wavelength to 1.2 times of the wavelength, wherein k=1, 2, 3, . . . , and $2^n$, and j=1, 2, 3, . . . , and $2^n$.

The feed network layer comprises a second metal plate, $4^n$ H-type single ridge waveguide power divider and a first E-plane waveguide power divider, wherein the $4^n$ H-type single ridge waveguide power divider and the first E-plane waveguide power divider are arranged on the second metal plate, and n is an integer greater than or equal to 1. Each H-type single ridge waveguide power divider has an input terminal and four output terminals. The $4^n$ H-type single ridge waveguide power dividers are evenly distributed in k rows and k columns to form a first-stage feed network array, wherein $k=\sqrt{4^n}$. Starting from a first row and a first column, the H-type single ridge waveguide power dividers in every two rows and every two columns form a first-stage H-type single ridge waveguide power dividing network unit of the first-stage feed network array. The first-stage feed network array comprises $4^{n-1}$ first-stage H-type single ridge waveguide power dividing network units. Input terminals of the four H-type single ridge waveguide power dividers in each first-stage H-type single ridge waveguide power dividing network unit are connected through an H-type single ridge waveguide power divider. A second-stage feed network array including j rows and j columns is formed by the H-type single ridge waveguide power dividers used for connecting the input terminals of the four H-type single ridge waveguide power dividers in each of the $4^{n-1}$ first-stage H-type single ridge waveguide power dividing network units, wherein $j=\sqrt{4^{n-1}}$. Starting from the first row and the first column, the H-type single ridge waveguide power dividers in every two rows and every two columns form a second-stage H-type single ridge waveguide power dividing network unit of the second-stage feed network array. The second-stage feed network array comprises $4^{n-2}$ second-stage H-type single ridge waveguide power dividing network units. The input terminals of the four H-type single ridge waveguide power dividers in each second-stage H-type single ridge waveguide power dividing network unit are connected through an H-type single ridge waveguide power divider. In this way, an $(n-1)^{th}$-stage H-type single ridge waveguide power dividing network unit including only four H-type single ridge waveguide power dividers is formed. The input terminals of the four H-type single ridge waveguide power dividers of the $(n-1)^{th}$-stage H-type single ridge waveguide power dividing network unit are connected through an H-type single ridge waveguide power divider, two output terminals of the first E-plane waveguide power divider are connected with the input terminal of one of the four H-type single ridge waveguide power dividers in the $(n-1)^{th}$-stage H-type single ridge waveguide power dividing network unit, and an input terminal of the first E-plane waveguide power divider is an input terminal of the low-profile CTS flat-plate array antenna. The four output terminals of each H-type single ridge waveguide power divider in the first-stage feed network array are provided with a single ridge waveguide-rectangular waveguide converter. In this structure, by adopting the H-type single ridge rectangular waveguide power dividers, the feed network layer fulfills input and output in a same direction, thereby being compact in structure, decreasing a cut-off frequency, widening a dominant modal bandwidth and realizing ultra-wideband high-efficiency feeding of the low-profile CTS flat-plate array antenna. Under a given frequency, the H-type single ridge rectangular waveguide power dividers can decrease a wide-side size of the antenna, reduce a weight of the antenna and make the antenna small.

Each single ridge waveguide-rectangular waveguide converter comprises a first rectangular metal block. A sixth rectangular cavity is formed in the first rectangular metal block, a first E-plane step and a first H-plane step are arranged in the sixth rectangular cavity, the first E-plane step is rectangular, a height of the first E-plane step is smaller than that of the sixth rectangular cavity, a lower end face of the first E-plane step is attached to a lower end face of the sixth rectangular cavity, a front end face of the first E-plane step is attached to a front end face of the sixth rectangular cavity, a rear end face of the first E-plane step is attached to a rear end face of the sixth rectangular cavity, a left end face of the first E-plane step is attached to the front end face of the sixth rectangular cavity, a rear end face of the first H-plane step is attached to the rear end face of the sixth rectangular cavity, a right end face of the first H-plane step is attached to a right end face of the sixth rectangular cavity, a lower end face of the first H-plane step is attached to the lower end face of the sixth rectangular cavity, a height of the first H-plane step is equal to that of the sixth rectangular cavity, a rectangular waveguide output port communicated with the sixth rectangular cavity is formed in an upper surface of the first rectangular metal block, a single ridge waveguide input port is formed in a front end face of the first rectangular metal block and communicated with the sixth rectangular cavity, a height of the single ridge waveguide input port is equal to that of the sixth rectangular cavity, a bottom surface of the single ridge waveguide input port and a bottom surface of the sixth rectangular cavity are located on a same plane, a left end face of the single ridge waveguide input port is flush with a right end face of the first E-plane step, and a right end face of the single ridge waveguide input port is flush with the right end face of the sixth rectangular cavity. A first ridge step extending onto the bottom surface of the sixth rectangular cavity is arranged on the bottom surface of the single ridge waveguide input port and comprises a first rectangular ridge and a second rectangular ridge which are sequentially connected, a height of the first rectangular ridge is greater than that of the second rectangular bridge and is smaller than that of the sixth rectangular cavity, a front end face of the first rectangular ridge is flush with a front end face of the single ridge waveguide input port, a rear end face of the first rectangular ridge is flush with a rear end face of the single ridge waveguide input port, the rear end face of the first rectangular ridge is attached to a front end face of the second rectangular ridge, a left end face of the first rectangular ridge is flush with a left end face of the second rectangular ridge, a right end face of the first rectangular ridge is flush with a right end face of the second rectangular ridge, a distance from the left end face of the first rectangular ridge to the right end face of the first E-plane step is equal to a distance from the right end face of the first rectangular ridge to the right end face of the sixth rectangular cavity, a rear end face of the second rectangular ridge is spaced from the first H-plane step by a certain distance, and the right end face of the first rectangular ridge is flush with a left end face of the first H-plane step. In this structure, the first E-plane step and the first H-plane step are arranged in each sixth rectangular cavity, the first ridge steps are used for realizing impedance matching and reducing a return loss caused by structural discontinuity, and thus, the structure has a good broadband transmission property.

The radiating layer comprises a first radiating unit and a second radiating unit. The first radiating unit comprises a third metal plate and $2^n$ second E-plane waveguide power dividers arranged on the third metal plate. The $2^n$ second E-plane waveguide power dividers are arrayed in $2^n$ rows and in 1 column, each second E-plane waveguide power divider has an input terminal and two output terminals, distances between the second E-plane waveguide power dividers in every two adjacent rows are equal, the input terminal of the second E-plane waveguide power divider in the $h^{th}$ row is communicated with the $2^n$ mode switching cavities in the $h^{th}$ row, and a center line of the input terminal of the second E-plane waveguide power divider in the $h^{th}$ row in the row direction and center lines of the $2^n$ mode switching cavities in the $h^{th}$ row in the row direction are located on a same plane which is perpendicular to the third metal plate 20, wherein h=1, 2, 3, . . . , $2^n$ The second radiating unit comprises a fourth metal plate and $2^{n+1}$ E-plane step horns arranged on the fourth metal plate, wherein the $2^{n+1}$ E-plane step horns are arrayed in $2^{n+1}$ rows and in 1 column, each E-plane step horn has an input terminal and an output terminal, distances between the E-plane step horns in every two adjacent rows are equal, and the output terminals of the $2^{n+1}$ E-plane step horns are communicated with the two output terminals of each of the $2^n$ second E-plane waveguide power dividers in a one-to-one correspondence manner.

Compared with the prior art, the invention has the following advantages. A single path of TE10 mode signal fed via a standard waveguide port by the feed network layer is converted into a plurality of paths of in-phase TE10 mode signals with the same power, and the multiple paths of constant-amplitude in-phase signals are fed into the mode switching layer including the first metal plate and the mode switching cavity array arranged on the first metal plate in such a manner that the multiple paths of constant-amplitude in-phase signals are spaced from one another by a distance twice of the waveguide wavelength, so that electromagnetic fields of the multiple paths of signals are kept consistent. Energy of the multiple paths of constant-amplitude in-phase signals is combined instead of being counteracted in the mode switching cavity, so that multiple paths of power are converted into one path of power. The mode switching cavity is formed by the first rectangular cavity, the second rectangular cavity, the third rectangular cavity, the fourth rectangular cavity and the fifth rectangular cavity having different widths and distributed front and back in a staggered manner and has a length equal to one wavelength so as to be matched with the electromagnetic field for TE10 mode transmission in the rectangular waveguide. When the electromagnetic field in the mode switching cavity passes through coupling slots, vector directions of the electromagnetic field deflects. The waveguide cavities are distributed by following such a rule that the vector directions of the electromagnetic fields in all the waveguide cavities will be kept the same after deflecting, so that a quasi-TEM mode line source is formed, quasi-TEM waves output by the mode switching cavities are radiated by E-plane planar waveguide power dividers and E-plane step horns of the radiating layer as plane waves, and transverse stubs between the adjacent mode switching cavities can obtain a high gain and a low minor lobe under broadband transmission. The mode switching cavities are compact in structural design and can complete TEM mode conversion in a same plane without a complex structure such as a reflecting surface, so that the machining difficulty is lowered, a low-profile design is achieved, and the CTS flat-plate array antenna is made small in size and easy to machine and assemble while having a broadband, a high gain and high efficiency.

DESCRIPTION OF THE EMBODIMENTS

Figure 1:
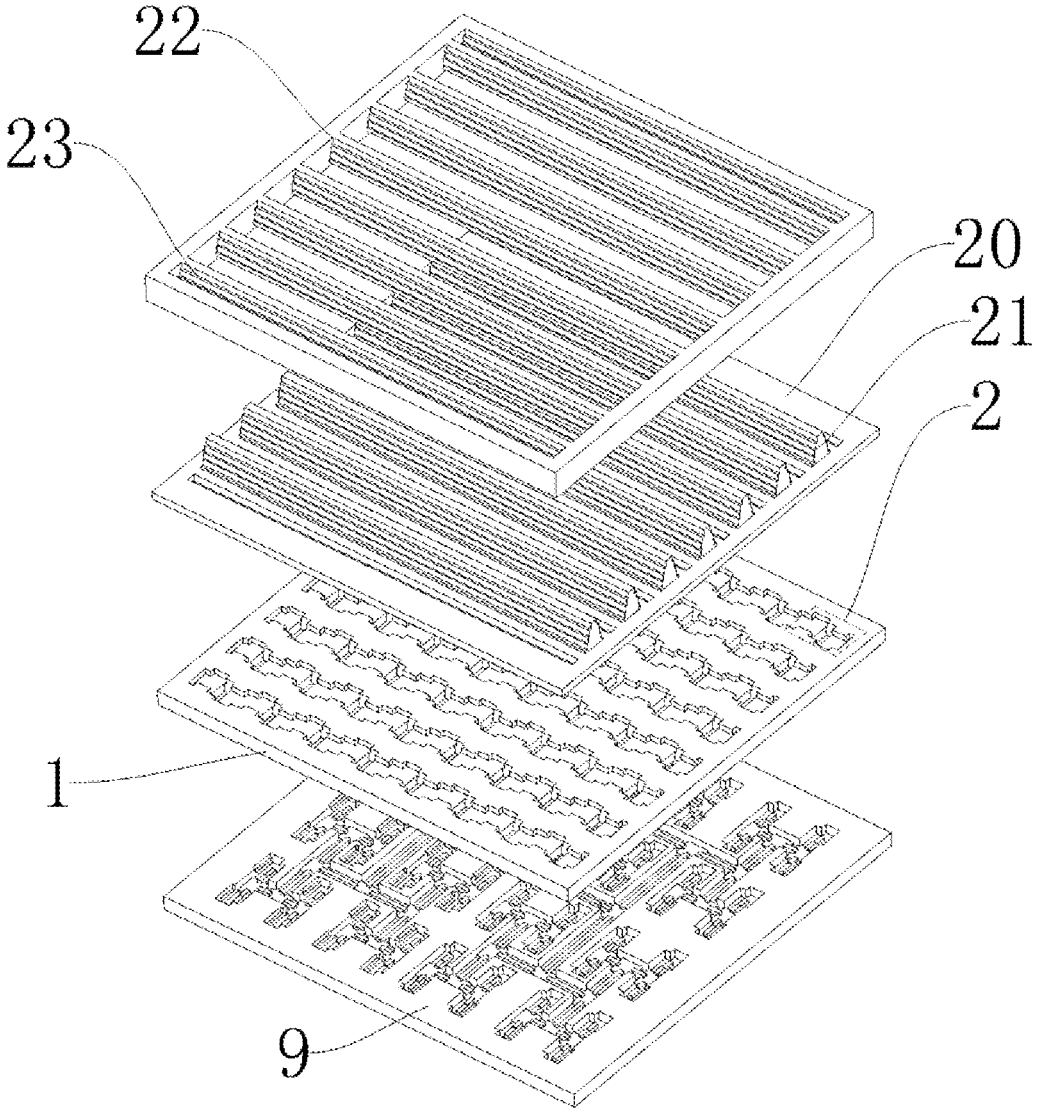
FIG. 1 is an exploded view of a low-profile CTS flat-plate array antenna of the invention.
Figure 2:
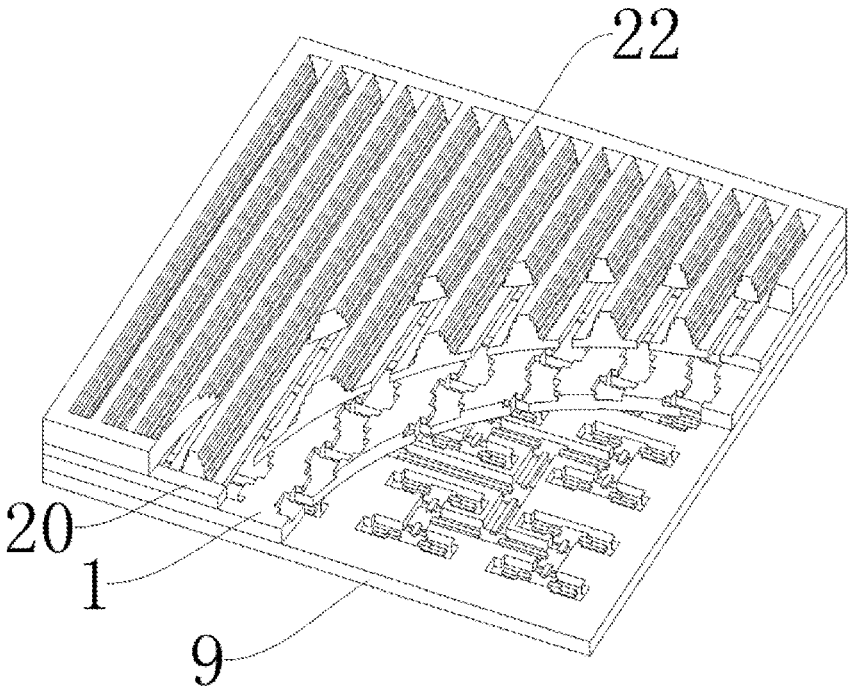
FIG. 2 is a partial sectional view of the low-profile CTS flat-plate array antenna of the invention.
Figure 3:
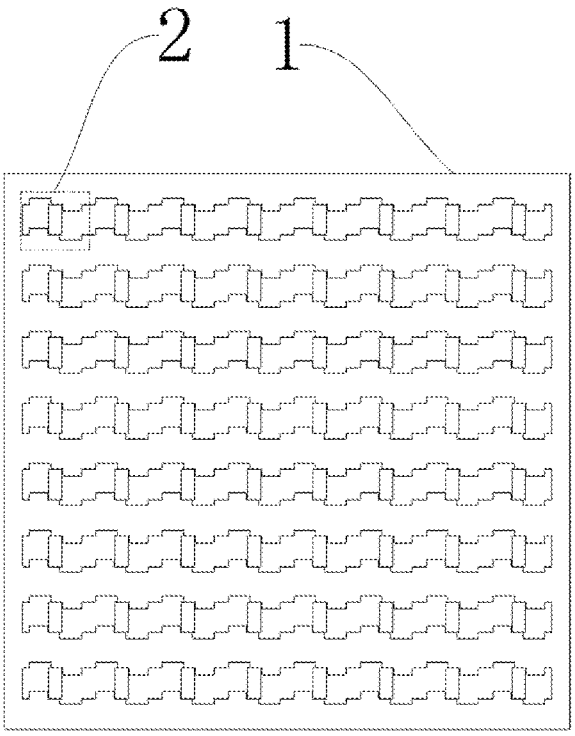
FIG. 3 is a top view of a mode switching layer of the low-profile CTS flat-plate array antenna of the invention.
Figure 4:
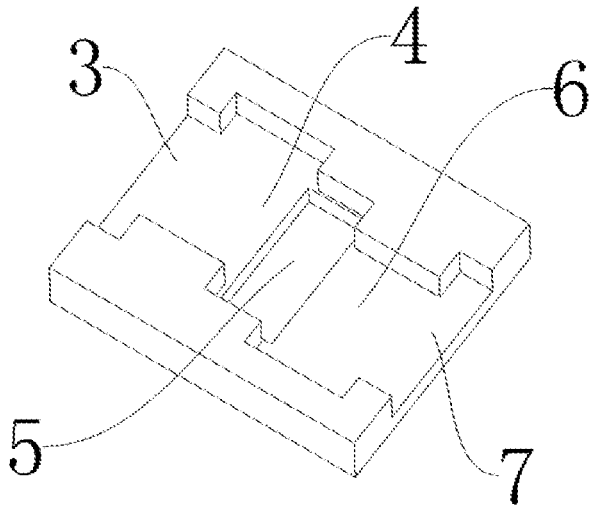
FIG. 4 is a structural view of a mode switching cavity of the low-profile CTS flat-plate array antenna of the invention.
Figure 5:
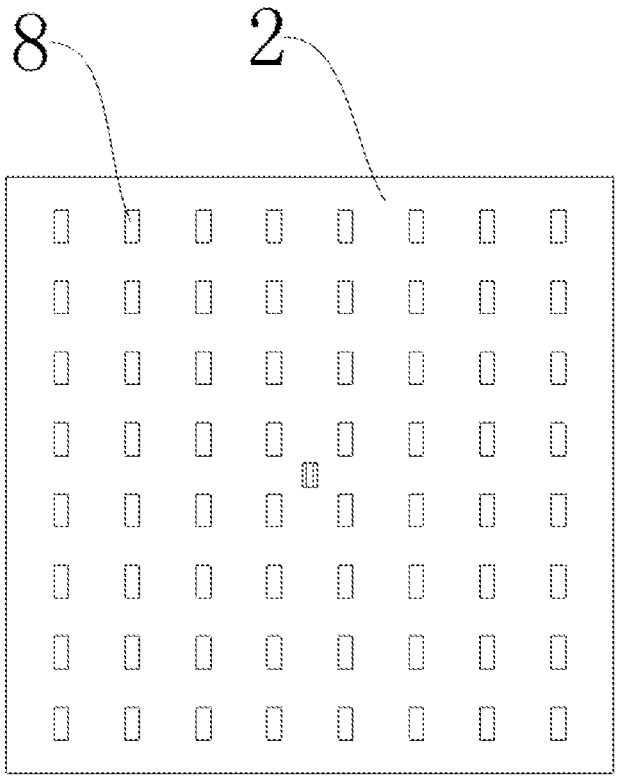
FIG. 5 is a bottom view of the mode switching layer of the low-profile CTS flat-plate array antenna of the invention.
Figure 6:
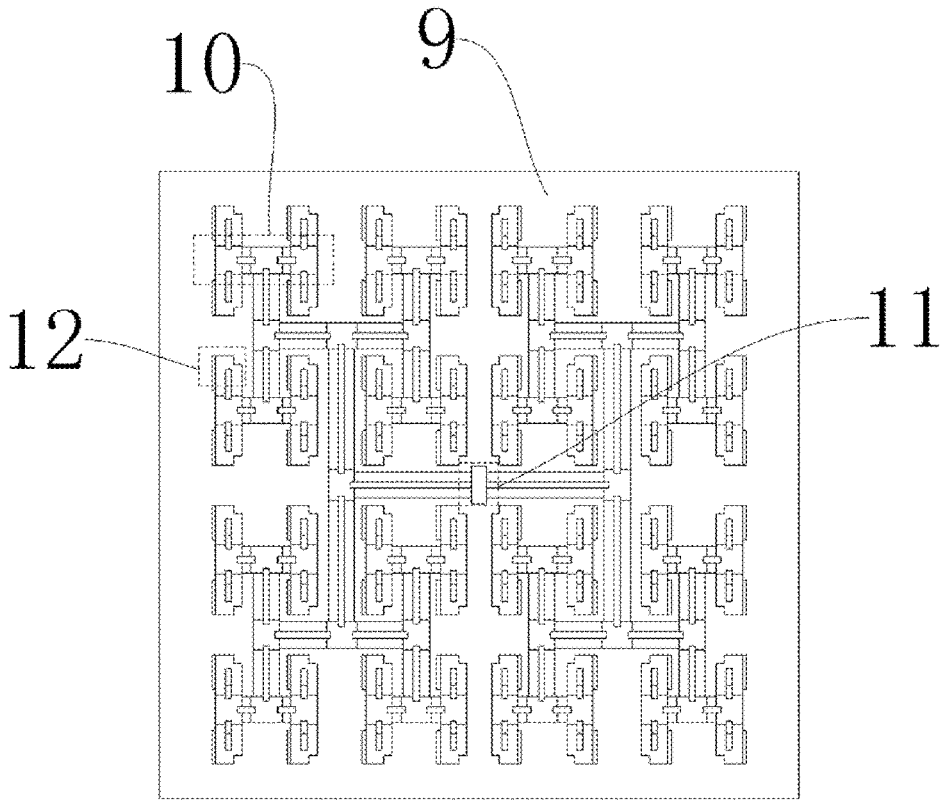
FIG. 6 is a top view of a feed network layer of the low-profile CTS flat-plate array antenna of the invention.
Figure 7:
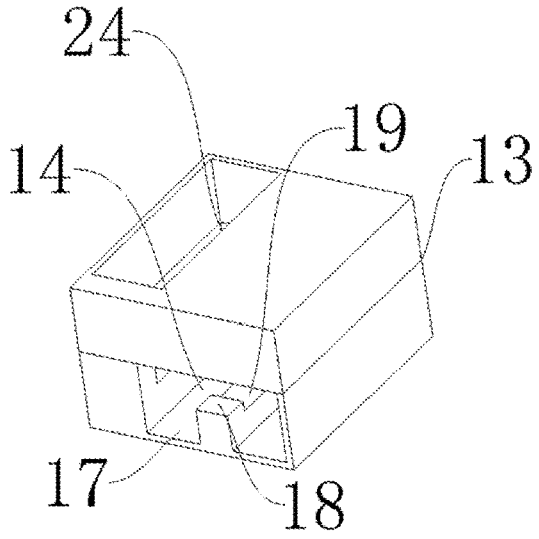
FIG. 7 is a perspective view of a single ridge waveguide-rectangular waveguide converter of the low-profile CTS flat-plate array antenna of the invention.
Figure 8:
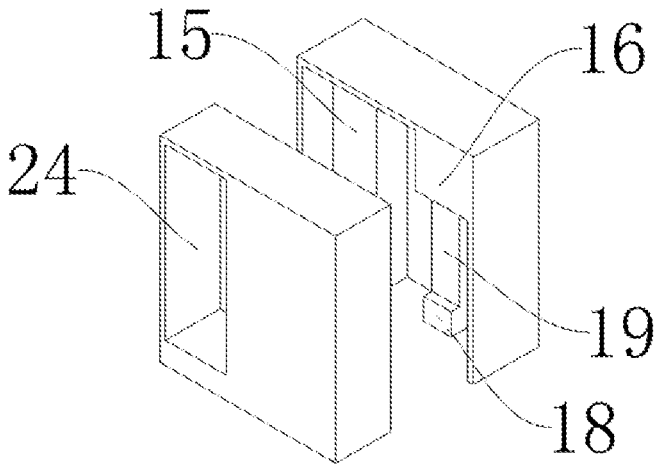
FIG. 8 is an exploded view of the single ridge waveguide-rectangular waveguide converter of the low-profile CTS flat-plate array antenna of the invention.

The invention is further expounded below with reference to the accompanying drawings and embodiments.

Embodiment

As shown in the figures, a low-profile CTS flat-plate array antenna comprises a radiating layer, a mode switching layer and a feed network layer which are sequentially arrayed from top to bottom. The mode switching layer comprises a first metal plate 1 and a mode switching cavity array arranged on an upper surface of the first metal plate 1. The mode switching cavity array comprises $2^{2n}$ mode switching cavities 2 which are arrayed in $2^n$ rows and $2^n$ columns, wherein n is an integer greater than or equal to 1, and the $2^n$ mode switching cavities 2 located in each row are sequentially connected end to end. Each mode switching cavity 2 comprises a first rectangular cavity 3, a second rectangular cavity 4, a third rectangular cavity 5, a fourth rectangular cavity 6 and a fifth rectangular cavity 7 which are sequentially connected from left to right. The first rectangular cavity 3, the second rectangular cavity 4, the third rectangular cavity 5, the fourth rectangular cavity 6 and the fifth rectangular cavity 7 have long edges in a row direction of the mode switching cavity array and wide edges in the column direction of the mode switching cavity array. With a center of the first rectangular cavity 3 as a baseline, a center of the second rectangular cavity 4 deviates forwards relative to the center of the first rectangular cavity 3. A front long edge of the second rectangular cavity 4 extends beyond a front long edge of the first rectangular cavity 3, a center of the third rectangular cavity 5 and the center of the first rectangular cavity 3 are located on a same line and are parallel to the long edges of the first rectangular cavity 3, the fourth rectangular cavity 6 and the second rectangular cavity 4 are symmetrical with respect to the center of the third rectangular cavity 5, and the fifth rectangular cavity 7 and the first rectangular cavity 3 are symmetrical with respect to the center of the third rectangular cavity 5; the first rectangular cavity 3, the second rectangular cavity 4, the third rectangular cavity 5, the fourth rectangular cavity 6 and the fifth rectangular cavity 7 are formed by rectangular grooves formed in the upper surface of the first metal plate 1, heights of the first rectangular cavity 3, the second rectangular cavity 4, the third rectangular cavity 5, the fourth rectangular cavity 6 and the fifth rectangular cavity 7 are equal and are smaller than a height of the first metal plate 1. A width of the first rectangular cavity 3 is smaller than that of the third rectangular cavity 5, a width of the third rectangular cavity 5 is smaller than that of the second rectangular cavity 4, a width of the second rectangular cavity 4 is smaller than half of a wavelength, a width of the fifth rectangular cavity 7 is equal to that of the first rectangular cavity 3, and a width of the fourth rectangular cavity 6 is equal to that of the second rectangular cavity 4. A lower surface of the first metal plate 1 is provided with $2^{2n}$ input ports 8 which are arrayed in $2^{2n}$ rows and $2^{2n}$ columns, formed by rectangular grooves formed in the lower surface of the first metal plate 1 and vertically communicated with the $2^{2n}$ mode switching cavities 2 in a one-to-one correspondence manner. As for each input port 8 and the mode switching cavity 2 correspondingly communicated with the input port 8, a vertical central axis of the input port 8 overlaps a vertical central axis of the third rectangular cavity 5 in the mode switching cavity 2, long edges of the input port 8 are parallel to the long edges of the third rectangular cavities 5 and are shorter than the long edges of the third rectangular cavity 5, and wide edges of the input port 8 are parallel to the wide edges of the third rectangular cavity 5 and are narrower than the wide edges of the third rectangular cavity 5. A center distance between the input port 8 in the $k^{th}$ row and the $j^{th}$ column and the input port 8 in the $k^{th}$ row and the $(j+1)^{th}$ column ranges from 0.8 time of the wavelength to 1.2 times of the wavelength, and the center distance between the input port 8 in the $k^{th}$ row and the $j^{th}$ column and the input port in the $(k+1)^{th}$ row and the $j^{th}$ column ranges from 0.8 time of the wavelength to 1.2 times of the wavelength, wherein k=1, 2, 3, . . . , and $2^n$, and j=1, 2, 3, . . . , and $2^n$.

In this embodiment, the feed network layer comprises a second metal plate 9, $4^n$ H-type single ridge waveguide power divider 10 and a first E-plane waveguide power divider 11. The $4^n$ H-type single ridge waveguide power divider 10 and the first E-plane waveguide power divider 11 are arranged on the second metal plate 9, and n is an integer greater than or equal to 1. Each H-type single ridge waveguide power divider 10 has an input terminal and four output terminals. The $4^n$ H-type single ridge waveguide power dividers 10 are evenly distributed in k rows and k columns to form a first-stage feed network array, wherein $k=\sqrt{4^n}$. Starting from a first row and a first column, the H-type single ridge waveguide power dividers 10 in every two rows and every two columns form a first-stage H-type single ridge waveguide power dividing network unit of the first-stage feed network array. The first-stage feed network array comprises $4^{n-1}$ first-stage H-type single ridge waveguide power dividing network units. The input terminals of the four H-type single ridge waveguide power dividers 10 in each first-stage H-type single ridge waveguide power dividing network unit are connected through an H-type single ridge waveguide power divider. A second-stage feed network array including j rows and j columns is formed by the H-type single ridge waveguide power dividers used for connecting the input terminals of the four H-type single ridge waveguide power dividers 10 in each of the $4^{n-1}$ first-stage H-type single ridge waveguide power dividing network units, wherein $j=\sqrt{4^{n-1}}$. Starting from the first row and the first column, the H-type single ridge waveguide power dividers in every two rows and every two columns form a second-stage H-type single ridge waveguide power dividing network unit of the second-stage feed network array. The second-stage feed network array comprises $4^{n-2}$ second-stage H-type single ridge waveguide power dividing network units. The input terminals of the four H-type single ridge waveguide power dividers in each second-stage H-type single ridge waveguide power dividing network unit are connected through an H-type single ridge waveguide power divider. In this way, an $(n-1)^{th}$-stage H-type single ridge waveguide power dividing network unit including only four H-type single ridge waveguide power dividers is formed. The input terminals of the four H-type single ridge waveguide power dividers of the $(n-1)^{th}$-stage H-type single ridge waveguide power dividing network unit are connected through an H-type single ridge waveguide power divider, two output terminals of the first E-plane waveguide power divider 11 are connected with the input terminal of one of the four H-type single ridge waveguide power dividers in the $(n-1)^{th}$-stage H-type single ridge waveguide power dividing network unit, and an input terminal of the first E-plane waveguide power divider 11 is an input terminal of the low-profile CTS flat-plate array antenna. The four output terminals of each H-type single ridge waveguide power divider 10 in the first-stage feed network array are provided with a single ridge waveguide-rectangular waveguide converter 12.

In this embodiment, each single ridge waveguide-rectangular waveguide converter 12 comprises a first rectangular metal block 13. A sixth rectangular cavity 14 is formed in the first rectangular metal block 13, a first E-plane step 15 and a first H-plane step 16 are arranged in the sixth rectangular cavity 14, the first E-plane step 15 is rectangular, a height of the first E-plane step 15 is smaller than that of the sixth rectangular cavity 14, a lower end face of the first E-plane step 15 is attached to a lower end face of the sixth rectangular cavity 14, a front end face of the first E-plane step 15 is attached to a front end face of the sixth rectangular cavity 14, a rear end face of the first E-plane step 15 is attached to a rear end face of the sixth rectangular cavity 14, a left end face of the first E-plane step 15 is attached to the front end face of the sixth rectangular cavity 14, a rear end face of the first H-plane step 16 is attached to the rear end face of the sixth rectangular cavity 14, a right end face of the first H-plane step 16 is attached to a right end face of the sixth rectangular cavity 14, a lower end face of the first H-plane step 16 is attached to the lower end face of the sixth rectangular cavity 14, a height of the first H-plane step 16 is equal to that of the sixth rectangular cavity 14, a rectangular waveguide output port 24 communicated with the sixth rectangular cavity 14 is formed in an upper surface of the first rectangular metal block 13, a single ridge waveguide input port 17 is formed in a front end face of the first rectangular metal block 13 and communicated with the sixth rectangular cavity 14, a height of the single ridge waveguide input port 17 is equal to that of the sixth rectangular cavity 14, a bottom surface of the single ridge waveguide input port 17 and a bottom surface of the sixth rectangular cavity 14 are located on a same plane, a left end face of the single ridge waveguide input port 17 is flush with a right end face of the first E-plane step 15, and a right end face of the single ridge waveguide input port 17 is flush with the right end face of the sixth rectangular cavity 14. A first ridge step extending onto the bottom surface of the sixth rectangular cavity 14 is arranged on the bottom surface of the single ridge waveguide input port 17 and comprises a first rectangular ridge 18 and a second rectangular ridge 19 which are sequentially connected, a height of the first rectangular ridge 18 is greater than that of the second rectangular bridge 19 and is smaller than that of the sixth rectangular cavity 14, a front end face of the first rectangular ridge 18 is flush with a front end face of the single ridge waveguide input port 17, a rear end face of the first rectangular ridge 18 is flush with a rear end face of the single ridge waveguide input port 17, the rear end face of the first rectangular ridge 18 is attached to a front end face of the second rectangular ridge 19, a left end face of the first rectangular ridge 18 is flush with a left end face of the second rectangular ridge 19, a right end face of the first rectangular ridge 18 is flush with a right end face of the second rectangular ridge 19, a distance from the left end face of the first rectangular ridge 18 to the right end face of the first E-plane step 15 is equal to a distance from the right end face of the first rectangular ridge 18 to the right end face of the sixth rectangular cavity 14, a rear end face of the second rectangular ridge 19 is spaced from the first H-plane step 16 by a certain distance, and the right end face of the first rectangular ridge 18 is flush with a left end face of the first H-plane step 16.

In this embodiment, the radiating layer comprises a first radiating unit and a second radiating unit. The first radiating unit comprises a third metal plate 20 and $2^n$ second E-plane waveguide power dividers 21 arranged on the third metal plate 20. The $2^n$ second E-plane waveguide power dividers 21 are arrayed in $2^n$ rows and in 1 column, each second E-plane waveguide power divider 21 has an input terminal and two output terminals, distances between the second E-plane waveguide power dividers 21 in every two adjacent rows are equal, the input terminal of the second E-plane waveguide power divider 21 in the $h^{th}$ row is communicated with the $2^n$ mode switching cavities 2 in the $h^{th}$ row, and a center line of the input terminal of the second E-plane waveguide power divider 21 in the $h^{th}$ row in the row direction and center lines of the $2^n$ mode switching cavities 2 in the $h^{th}$ row in the row direction are located on a same plane which is perpendicular to the third metal plate 20, wherein h=1, 2, 3, . . . , $2^n$. The second radiating unit comprises a fourth metal plate 22 and $2^{n+1}$ E-plane step horns 23 arranged on the fourth metal plate 22. The $2^{n+1}$ E-plane step horns 23 are arrayed in $2^{n+1}$ rows and in 1 column, each E-plane step horn 23 has an input terminal and an output terminal, distances between the E-plane step horns 23 in every two adjacent rows are equal, and output terminals of the $2^{n+1}$ E-plane step horns 23 are communicated with the two output terminals of each of the $2^n$ second E-plane waveguide power dividers 21 in a one-to-one correspondence manner.

In this embodiment, the H-type single ridge waveguide power dividers, the first E-plane waveguide power dividers 11, the second E-plane waveguide power dividers 21 and the E-plane step horns 23 are all mature products in corresponding technical fields.

What is claimed is:

1. A low-profile CTS flat-plate array antenna, comprising a radiating layer, a mode switching layer and a feed network layer which are sequentially arrayed from top to bottom, wherein the mode switching layer comprises a first metal plate and a mode switching cavity array arranged on an upper surface of the first metal plate, the mode switching cavity array comprises $2^{2n}$ mode switching cavities which are arrayed in $2^n$ rows and $2^n$ columns, n is an integer greater than or equal to 1, and the $2^n$ mode switching cavities located in each row are sequentially connected end to end;

each said mode switching cavity comprises a first rectangular cavity, a second rectangular cavity, a third rectangular cavity, a fourth rectangular cavity and a fifth rectangular cavity which are sequentially connected from left to right, wherein the first rectangular cavity, the second rectangular cavity, the third rectangular cavity, the fourth rectangular cavity and the fifth rectangular cavity have long edges in a row direction of the mode switching cavity array and wide edges in a column direction of the mode switching cavity array; with a center of the first rectangular cavity as a baseline, a center of the second rectangular cavity deviates forwards relative to the center of the first rectangular cavity; a front long edge of the second rectangular cavity extends beyond a front long edge of the first rectangular cavity, a center of the third rectangular cavity and the center of the first rectangular cavity are located on a same line and are parallel to the long edges of the first rectangular cavity, the fourth rectangular cavity and the second rectangular cavity are symmetrical with respect to the center of the third rectangular cavity, and the fifth rectangular cavity and the first rectangular cavity are symmetrical with respect to the center of the third rectangular cavity; the first rectangular cavity, the second rectangular cavity, the third rectangular cavity, the fourth rectangular cavity and the fifth rectangular cavity are formed by rectangular grooves formed in the upper surface of the first metal plate, heights of the first rectangular cavity, the second rectangular cavity, the third rectangular cavity, the fourth rectangular cavity and the fifth rectangular cavity are equal and are smaller than a height of the first metal plate; a width of the first rectangular cavity is smaller than that of the third rectangular cavity, a width of the third rectangular cavity is smaller than that of the second rectangular cavity, a width of the second rectangular cavity is smaller than half of a wavelength, a width of the fifth rectangular cavity is equal to that of the first rectangular cavity, and a width of the fourth rectangular cavity is equal to that of the second rectangular cavity; a lower surface of the first metal plate is provided with $2^{2n}$ input ports which are arrayed in $2^{2n}$ rows and $2^{2n}$ columns, formed by rectangular grooves formed in the lower surface of the first metal plate and vertically communicated with the $2^{2n}$ mode switching cavities in a one-to-one correspondence manner; as for each said input port and the mode switching cavity correspondingly communicated with the input port, a vertical central axis of the input port overlaps a vertical central axis of the third rectangular cavity of the mode switching cavity, long edges of the input port are parallel to the long edges of the third rectangular cavity and are shorter than the long edges of the third rectangular cavity, and wide edges of the input port are parallel to the wide edges of the third rectangular cavity and are narrower than the wide edges of the third rectangular cavity;

a center distance between the input port in the $k^{th}$ row and the $j^{th}$ column and the input port in the $k^{th}$ row and the $(j+1)^{th}$ column ranges from 0.8 time of the wavelength to 1.2 times of the wavelength, and the center distance between the input port in the $k^{th}$ row and the $j^{th}$ column and the input port in the $(k+1)^{th}$ row and the $j^{th}$ column ranges from 0.8 time of the wavelength to 1.2 times of the wavelength, wherein k=1, 2, 3, . . . , and $2^n$, and j=1, 2, 3, . . . , and $2^n$.

2. The low-profile CTS flat-plate array antenna according to claim 1, wherein the feed network layer comprises a second metal plate, $4^n$ H-type single ridge waveguide power dividers and a first E-plane waveguide power divider, the $4^n$ H-type single ridge waveguide power dividers and the first E-plane waveguide power divider are arranged on the second metal plate, and n is an integer greater than or equal to 1; each said H-type single ridge waveguide power divider has an input terminal and four output terminals; the $4^n$ H-type single ridge waveguide power dividers are evenly distributed in k rows and k columns to form a first-stage feed network array, wherein $k=\sqrt{4^n}$; starting from a first row and a first column, the H-type single ridge waveguide power dividers in every two rows and every two columns form a first-stage H-type single ridge waveguide power dividing network unit of the first-stage feed network array, the first-stage feed network array comprises $4^{n-1}$ said first-stage H-type single ridge waveguide power dividing network units, input terminals of the four H-type single ridge waveguide power dividers in each said first-stage H-type single ridge waveguide power dividing network unit are connected through an H-type single ridge waveguide power divider; a second-stage feed network array including j rows and j columns is formed by the H-type single ridge waveguide power dividers used for connecting the input terminals of the four H-type single ridge waveguide power dividers in each of the $4^{n-1}$ first-stage H-type single ridge waveguide power dividing network unit, wherein $j=\sqrt{4^{n-1}}$; starting from the first row and the first column, the H-type single ridge waveguide power dividers in every two rows and every two columns form a second-stage H-type single ridge waveguide power dividing network unit of the second-stage feed network array, the second-stage feed network array comprises $4^{n-2}$ said second-stage H-type single ridge waveguide power dividing network units, and the input terminals of the four H-type single ridge waveguide power dividers in each said second-stage H-type single ridge waveguide power dividing network unit are connected through an H-type single ridge waveguide power divider; in this way, an $(n-1)^{th}$-stage H-type single ridge waveguide power dividing network unit including only four of said H-type single ridge waveguide power dividers is formed, wherein the input terminals of the four H-type single ridge waveguide power dividers of the $(n-1)^{th}$-stage H-type single ridge waveguide power dividing network unit are connected through an H-type single ridge waveguide power divider, two output terminals of the first E-plane waveguide power divider are connected with the input terminal of one of the four H-type single ridge waveguide power dividers in the $(n-1)^{th}$-stage H-type single ridge waveguide power dividing network unit, and an input terminal of the first E-plane waveguide power divider is an input terminal of the low-profile CTS flat-plate array antenna; the four output terminals of each of the four H-type single ridge waveguide power divider in the first-stage feed network array are provided with a single ridge waveguide-rectangular waveguide converter.

3. The low-profile CTS flat-plate array antenna according to claim 2, wherein each said single ridge waveguide-rectangular waveguide converter comprises a first rectangular metal block, a sixth rectangular cavity is formed in the first rectangular metal block, a first E-plane step and a first H-plane step are arranged in the sixth rectangular cavity, the first E-plane step is rectangular, a height of the first E-plane step is smaller than that of the sixth rectangular cavity, a lower end face of the first E-plane step is attached to a lower end face of the sixth rectangular cavity, a front end face of the first E-plane step is attached to a front end face of the sixth rectangular cavity, a rear end face of the first E-plane step is attached to a rear end face of the sixth rectangular cavity, a left end face of the first E-plane step is attached to a left end face of the sixth rectangular cavity, a rear end face of the first H-plane step is attached to the rear end face of the sixth rectangular cavity, a right end face of the first H-plane step is attached to a right end face of the sixth rectangular cavity, a lower end face of the first H-plane step is attached to the lower end face of the sixth rectangular cavity, a height of the first H-plane step is equal to that of the sixth rectangular cavity, a rectangular waveguide output port communicated with the sixth rectangular cavity is formed in an upper surface of the first rectangular metal block, a single ridge waveguide input port is formed in a front end face of the first rectangular metal block and communicated with the sixth rectangular cavity, a height of the single ridge waveguide input port is equal to that of the sixth rectangular cavity, a bottom surface of the single ridge waveguide input port and a bottom surface of the sixth rectangular cavity are located on a same plane, a left end face of the single ridge waveguide input port is flush with a right end face of the first E-plane step, and a right end face of the single ridge waveguide input port is flush with the right end face of the sixth rectangular cavity; a first ridge step extending onto the bottom surface of the sixth rectangular cavity is arranged on the bottom surface of the single ridge waveguide input port and comprises a first rectangular ridge and a second rectangular ridge which are sequentially connected, a height of the first rectangular ridge is greater than that of the second rectangular bridge and is smaller than that of the sixth rectangular cavity, a front end face of the first rectangular ridge is flush with a front end face of the single ridge waveguide input port, a rear end face of the first rectangular ridge is flush with a rear end face of the single ridge waveguide input port, the rear end face of the first rectangular ridge is attached to a front end face of the second rectangular ridge, a left end face of the first rectangular ridge is flush with a left end face of the second rectangular ridge, a right end face of the first rectangular ridge is flush with a right end face of the second rectangular ridge, a distance from the left end face of the first rectangular ridge to the right end face of the first E-plane step is equal to a distance from the right end face of the first rectangular ridge to the right end face of the sixth rectangular cavity, a rear end face of the second rectangular ridge is spaced from the first H-plane step by a certain distance, and the right end face of the first rectangular ridge is flush with a left end face of the first H-plane step.

4. The low-profile CTS flat-plate array antenna according to claim 1, wherein the radiating layer comprises a first radiating unit and a second radiating unit, the first radiating unit comprises a third metal plate and $2^n$ second E-plane waveguide power dividers arranged on the third metal plate, the $2^n$ second E-plane waveguide power dividers are arrayed in $2^n$ rows and in 1 column, each said second E-plane waveguide power divider has an input terminal and two output terminals, distances between the second E-plane waveguide power dividers in every two adjacent rows are equal, the input terminal of the second E-plane waveguide power divider in the $h^{th}$ row is communicated with $2^n$ mode switching cavities in the $h^{th}$ row, and a center line of the input terminal of the second E-plane waveguide power divider in the $h^{th}$ row in the row direction and center lines of the $2^n$ mode switching cavities in the $h^{th}$ row in the row direction are located on a same plane which is perpendicular to the third metal plate, wherein h=1, 2, 3, . . . , $2^n$; the second radiating unit comprises a fourth metal plate and $2^{n+1}$ E-plane step horns arranged on the fourth metal plate, wherein the $2^{n+1}$ E-plane step horns are arrayed in $2^{n+1}$ rows and in 1 column, each said E-plane step horn has an input terminal and an output terminal, distances between the E-plane step horns in every two adjacent rows are equal, and output terminals of the $2^{n+1}$ E-plane step horns are communicated with the two output terminals of each of the $2^n$ second E-plane waveguide power dividers in a one-to-one correspondence manner.

* * * * *